US011092378B1

(12) United States Patent
Small

(10) Patent No.: US 11,092,378 B1
(45) Date of Patent: Aug. 17, 2021

(54) REFRIGERATOR WITH DUAL SENSOR CONTROL WITH ADAPTIVE ALGORITHM

(71) Applicant: Electrolux Home Products, Inc., Charlotte, NC (US)

(72) Inventor: William L. Small, Belton, SC (US)

(73) Assignee: Electrolux Home Products, Inc., Charlotte, NC (US)

( * ) Notice: Subject to any disclaimer, the term of this patent is extended or adjusted under 35 U.S.C. 154(b) by 0 days.

(21) Appl. No.: 16/861,319

(22) Filed: Apr. 29, 2020

(51) Int. Cl.

| | |
|---|---|
| ***F25D 27/00*** | (2006.01) |
| ***F25D 23/04*** | (2006.01) |
| ***F25D 23/12*** | (2006.01) |
| ***F21V 33/00*** | (2006.01) |
| ***F21V 23/04*** | (2006.01) |
| *F21W 131/305* | (2006.01) |

(52) U.S. Cl.
CPC ..... *F25D 27/005* (2013.01); *F21V 23/0471* (2013.01); *F21V 33/0044* (2013.01); *F25D 23/04* (2013.01); *F25D 23/126* (2013.01); *F21W 2131/305* (2013.01); *F25D 2700/04* (2013.01)

(58) Field of Classification Search
CPC ..... F25D 27/005; F25D 23/04; F25D 23/126; F25D 2700/04; F21V 23/0471; F21V 33/0044; F21V 23/0402; F21W 2131/305
See application file for complete search history.

(56) References Cited

U.S. PATENT DOCUMENTS

| | | | | |
|---|---|---|---|---|
| 9,417,003 | B2 | 8/2016 | Baack | |
| 9,642,214 | B2 | 5/2017 | Kendall et al. | |
| 9,795,010 | B2 | 10/2017 | Kendall et al. | |
| 10,223,956 | B2 | 3/2019 | Yoo et al. | |
| 10,295,248 | B2 | 5/2019 | Miller et al. | |
| 2018/0156535 | A1* | 6/2018 | Kim | F25D 27/005 |

* cited by examiner

*Primary Examiner* — Bao Q Truong
(74) *Attorney, Agent, or Firm* — Pearne & Gordon LLP

(57) ABSTRACT

A refrigerator includes: a cabinet defining a refrigeration compartment with an opening and a door pivotally connected with the cabinet; a see-through door with an interior light for illuminating the refrigeration compartment and/or a dispenser mounted in the door or in the cabinet for dispensing water and/or ice; and a sensor unit operatively associated with the interior light and/or the dispenser, the sensor unit including at least two spaced apart sensors in operational communication with a controller, each sensor producing an output signal, the controller senses a timing difference between the output signals from the at least two sensors caused by the movement of the operator to control dispensing, and the controller establishes a calibration setting based on the output signals of the sensor where ambient changes to the output signals are differentiated from the timing difference.

14 Claims, 4 Drawing Sheets

REFRIGERATOR WITH DUAL SENSOR CONTROL WITH ADAPTIVE ALGORITHM

FIELD OF THE INVENTION

The invention is directed to a refrigerator with a dual sensor control with an adaptive control.

BACKGROUND OF THE INVENTION

Conventional refrigeration appliances, such as domestic refrigerators, typically have both a fresh food compartment or section and a freezer compartment or section. The fresh food compartment is where food items such as fruits, vegetables, and beverages are stored. The freezer compartment is where food items that are to be kept in a frozen condition are stored. The refrigerators are provided with refrigeration systems that maintains the fresh food compartment at temperatures above 0° C., such as between 0.25° C. and 4.5° C. and the freezer compartments at temperatures below 0° C., such as between 0° C. and −20° C.

The arrangements of the fresh food and freezer compartments with respect to one another in such refrigerators vary. For example, in some cases, the freezer compartment is located above the fresh food compartment and in other cases the freezer compartment is located below the fresh food compartment. Additionally, many modern refrigerators have their freezer compartments and fresh food compartments arranged in a side-by-side relationship. Whatever arrangement of the freezer compartment and the fresh food compartment is employed, typically, separate access doors are provided for the compartments so that either compartment can be accessed without exposing the other compartment to the ambient air.

Additionally, these refrigerators may include a see-through door (e.g., a 'glass door') and/or a dispenser for, for example, water and/or ice. The interior light of the see-through door embodiment and/or the dispenser may be controlled indirectly by the movement of the operator in proximity to the refrigerator. Such controller may be confused by changes in ambient conditions that influence the controller. For example, conventional IR sensor are susceptible to ambient sources of IR, such as sunlight and incandescent light, which can blind or overwhelm the sensor. There is a need for improved controllers.

SUMMARY OF THE INVENTION

A refrigerator includes: a cabinet defining a refrigeration compartment with an opening and a door pivotally connected with the cabinet; a see-through door with an interior light for illuminating the refrigeration compartment and/or a dispenser mounted in the door or in the cabinet for dispensing water and/or ice; and a sensor unit operatively associated with the interior light and/or the dispenser, the sensor unit including at least two spaced apart sensors in operational communication with a controller, each sensor producing an output signal, the controller senses a timing difference between the output signals from the at least two sensors caused by the movement of the operator to control dispensing, and the controller establishes a calibration setting based on the output signals of the sensor where ambient changes to the output signals are differentiated from the timing difference.

DESCRIPTION OF THE DRAWINGS

For the purpose of illustrating the invention, there is shown in the drawings a form that is presently preferred; it being understood, however, that this invention is not limited to the precise arrangements and instrumentalities shown. The accompanying drawings, which are not necessarily to scale, show various aspects of the disclosure.

DESCRIPTION OF THE INVENTION

Figure 1:
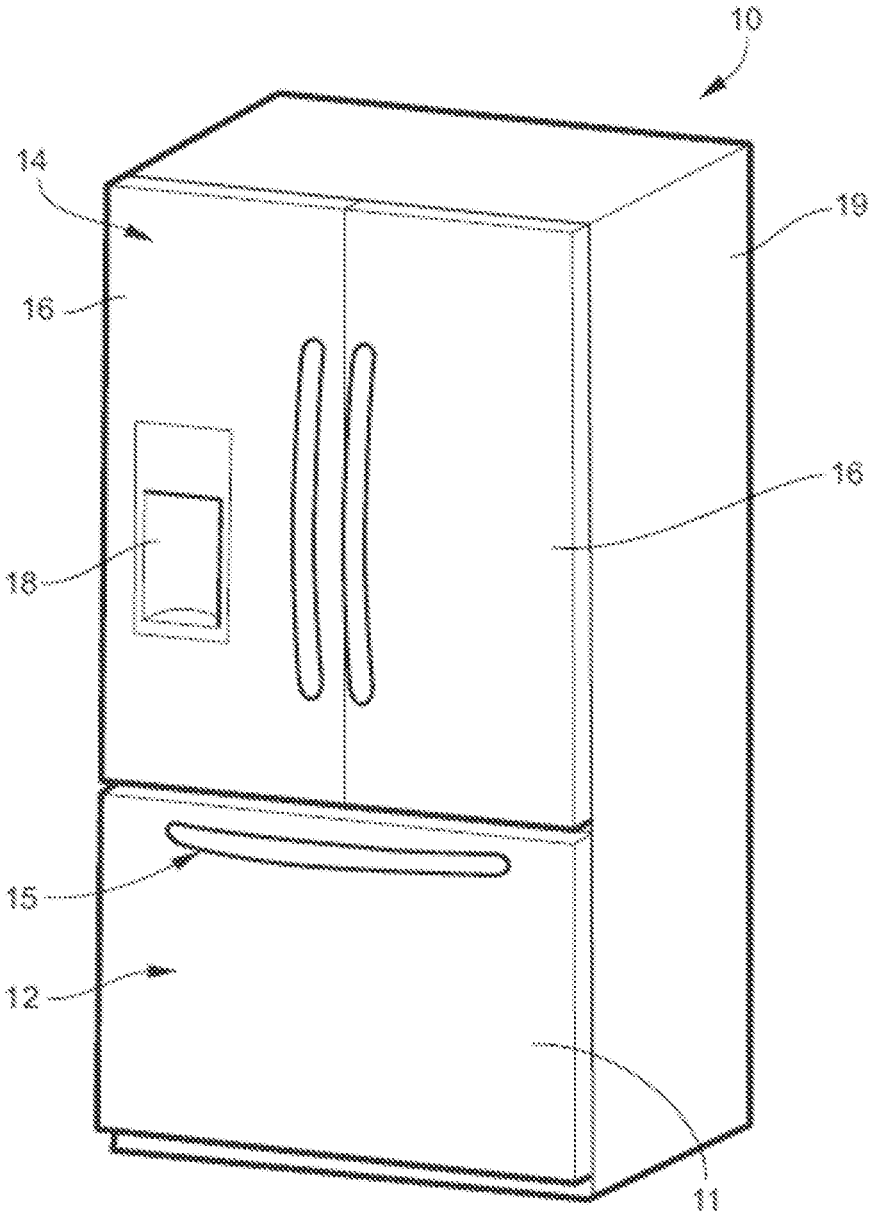
FIG. 1 Prior Art
FIG. 1 is a front perspective view of a prior art household French door bottom mount refrigeration appliance showing doors of the fresh food compartment and drawer of a freezer compartment in a closed position.

Embodiments of a refrigerator or a component thereof now will be described with reference to the accompanying drawings. Whenever possible, the same reference numerals are used throughout the drawings to refer to the same or like parts.

Figure 2:
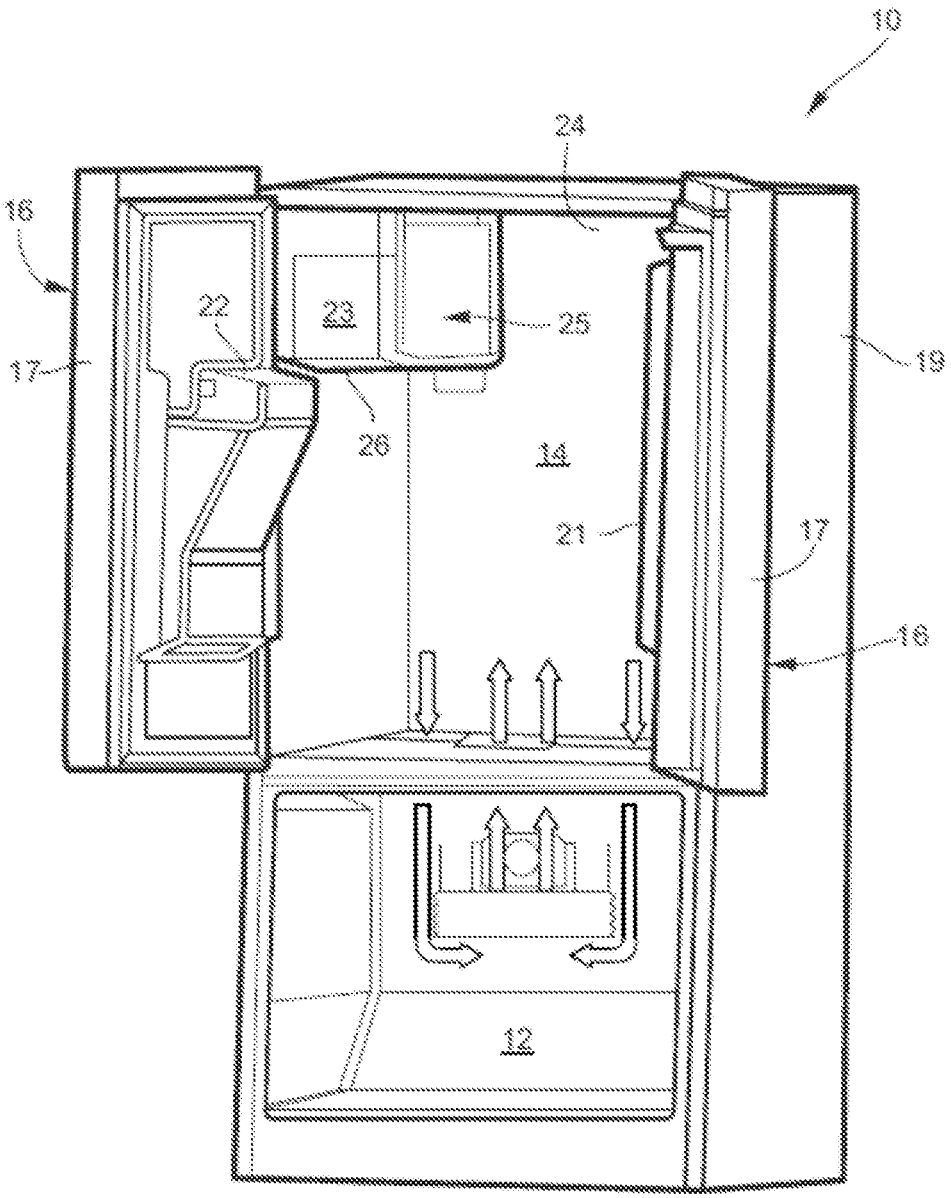
FIG. 2 Prior Art
FIG. 2 is a front perspective view of the prior art refrigeration appliance of FIG. 1 showing the doors of the fresh food compartment in opened positions and the drawer of the freezer compartment removed.

Referring now to the drawings, FIGS. 1 and 2 show a refrigeration appliance in the form of a domestic refrigerator, indicated generally at 10. Although the detailed description that follows concerns a domestic refrigerator 10, the invention can be embodied by refrigeration appliances other than a domestic refrigerator 10. An embodiment is described in detail below, and shown in the figures as a bottom-mount configuration of a refrigerator 10, including a fresh food compartment 14 disposed vertically above a freezer compartment 12. However, the refrigerator 10 can have any desired configuration including at least a fresh food compartment 14 and/or a freezer compartment 12, such as a top mount refrigerator (freezer disposed above the fresh food compartment), a side-by-side refrigerator (fresh food compartment is laterally next to the freezer compartment), a standalone refrigerator or freezer, etc.

One or more doors 16 shown in FIG. 1 are pivotably coupled to a cabinet 19 of the refrigerator 10 to restrict and grant access to the fresh food compartment 14. The door 16 can include a single door that spans the entire lateral distance across the entrance to the fresh food compartment 14, or can include a pair of French-type doors 16 as shown in FIG. 1 that collectively span the entire lateral distance of the entrance to the fresh food compartment 14 to enclose the fresh food compartment 14. In one embodiment of the door 16, the door may have a "see-through" (or glass) front panel (not shown). The see-through door allows inspection of the content of the refrigerator without opening the door, thereby minimizing heat loss from the refrigerator. The see-through door is conventional and may include a thermal pane (e.g., two parallel sheets of glass with a vacuum therebetween). Additionally, a interior light may be associated with the cabinet and that light may be activated (turned on and/or my the proximity of an operator to facilitate inspection of the contents of the cabinet.

For the latter configuration, a center flip mullion 21 (FIG. 2) is pivotally coupled to at least one of the doors 16 to establish a surface against which a seal provided to the other one of the doors 16 can seal the entrance to the fresh food compartment 14 at a location between opposing side surfaces 17 (FIG. 2) of the doors 16. The mullion 21 can be pivotably coupled to the door 16 to pivot between a first orientation that is substantially parallel to a planar surface of the door 16 when the door 16 is closed, and a different orientation when the door 16 is opened. The externally exposed surface of the center mullion 21 is substantially parallel to the door 16 when the center mullion 21 is in the first orientation and forms an angle other than parallel relative to the door 16 when the center mullion 21 is in the second orientation. The seal and the externally exposed surface of the mullion 21 cooperate approximately midway between the lateral sides of the fresh food compartment 14.

A dispenser 18 (FIG. 1) for dispensing at least ice pieces, and optionally water, may be provided on an exterior of one of the doors 16 that restricts access to the fresh food compartment 14. The dispenser 18 includes an actuator (e.g., lever, switch, proximity sensor, etc.) to cause frozen ice pieces to be dispensed from an ice bin 23 (FIG. 2) of an ice maker 25 disposed within the fresh food compartment 14. Ice pieces from the ice bin 23 can exit the ice bin 23 through an aperture 26 and be delivered to the dispenser 18 via an ice chute 22 (FIG. 2), which extends at least partially through the door 16 between the dispenser 18 and the ice bin 23.

The freezer compartment 12 is arranged vertically beneath the fresh food compartment 14. A drawer assembly (not shown) including one or more freezer baskets (not shown) can be withdrawn from the freezer compartment 12 to grant a user access to food items stored in the freezer compartment 12. The drawer assembly can be coupled to a freezer door 11 that includes a handle 15. When a user grasps the handle 15 and pulls the freezer door 11 open, at least one or more of the freezer baskets is caused to be at least partially withdrawn from the freezer compartment 12.

In alternative embodiments, the ice maker is located within the freezer compartment. In this configuration, although still disposed within the freezer compartment, at least the ice maker (and possible an ice bin) is mounted to an interior surface of the freezer door. It is contemplated that the ice mold and ice bin can be separate elements, in which one remains within the freezer compartment and the other is on the freezer door.

The freezer compartment 12 is used to freeze and/or maintain articles of food stored in the freezer compartment 12 in a frozen condition. For this purpose, the freezer compartment 12 is in thermal communication with a freezer evaporator (not shown) that removes thermal energy from the freezer compartment 12 to maintain the temperature therein at a temperature of 0° C. or less during operation of the refrigerator 10, preferably between 0° C. and −50° C., more preferably between 0° C. and −30° C. and even more preferably between 0° C. and −20° C.

The refrigerator 10 includes an interior liner 24 (FIG. 2) that defines the fresh food compartment 14. The fresh food compartment 14 is located in the upper portion of the refrigerator 10 in this example and serves to minimize spoiling of articles of food stored therein. The fresh food compartment 14 accomplishes this aim by maintaining the temperature in the fresh food compartment 14 at a cool temperature that is typically above 0° C., so as not to freeze the articles of food in the fresh food compartment 14. It is contemplated that the cool temperature preferably is between 0° C. and 10° C., more preferably between 0° C. and 5° C. and even more preferably between 0.25° C. and 4.5° C.

According to some embodiments, cool air from which thermal energy has been removed by the freezer evaporator can also be blown into the fresh food compartment 14 to maintain the temperature therein greater than 0° C. preferably between 0° C. and 10° C., more preferably between 0° C. and 5° C. and even more preferably between 0.25° C. and 4.5° C. For alternate embodiments, a separate fresh food evaporator can optionally be dedicated to separately maintaining the temperature within the fresh food compartment 14 independent of the freezer compartment 12.

According to an embodiment, the temperature in the fresh food compartment 14 can be maintained at a cool temperature within a close tolerance of a range between 0° C. and 4.5° C., including any subranges and any individual temperatures falling with that range. For example, other embodiments can optionally maintain the cool temperature within the fresh food compartment 14 within a reasonably close tolerance of a temperature between 0.25° C. and 4° C.

In some embodiments of the refrigerator 10, the interior light and/or the dispenser 18 may be actuated by a proximity sensor, described hereinafter. The refrigerator 10 generally includes: a cabinet defining a refrigeration compartment with an opening and a door pivotally connected with the cabinet for movement between an open position allowing access to the refrigeration compartment and a closed position sealing the refrigeration compartment; a see-through door with an interior light for illuminating the refrigeration compartment and/or a dispenser mounted in the door or in the cabinet for dispensing water and/or ice; a sensor unit operatively associated with the interior light for controlling the interior light activation without direct contact via movement of the an operator in proximity to the refrigerator and/or the dispenser for controlling dispensing of water/or ice without direct contact via the movement of an operator in proximity to the refrigerator, the sensor unit including at least two spaced apart sensors in operational communication with a controller, each sensor producing an output signal, the controller senses a timing difference between the output signals from the at least two sensors caused by the movement of the operator to control dispensing, and the controller establishes a calibration setting based on the output signals of the sensor where ambient changes to the output signals are differentiated from the timing difference.

Figure 3:
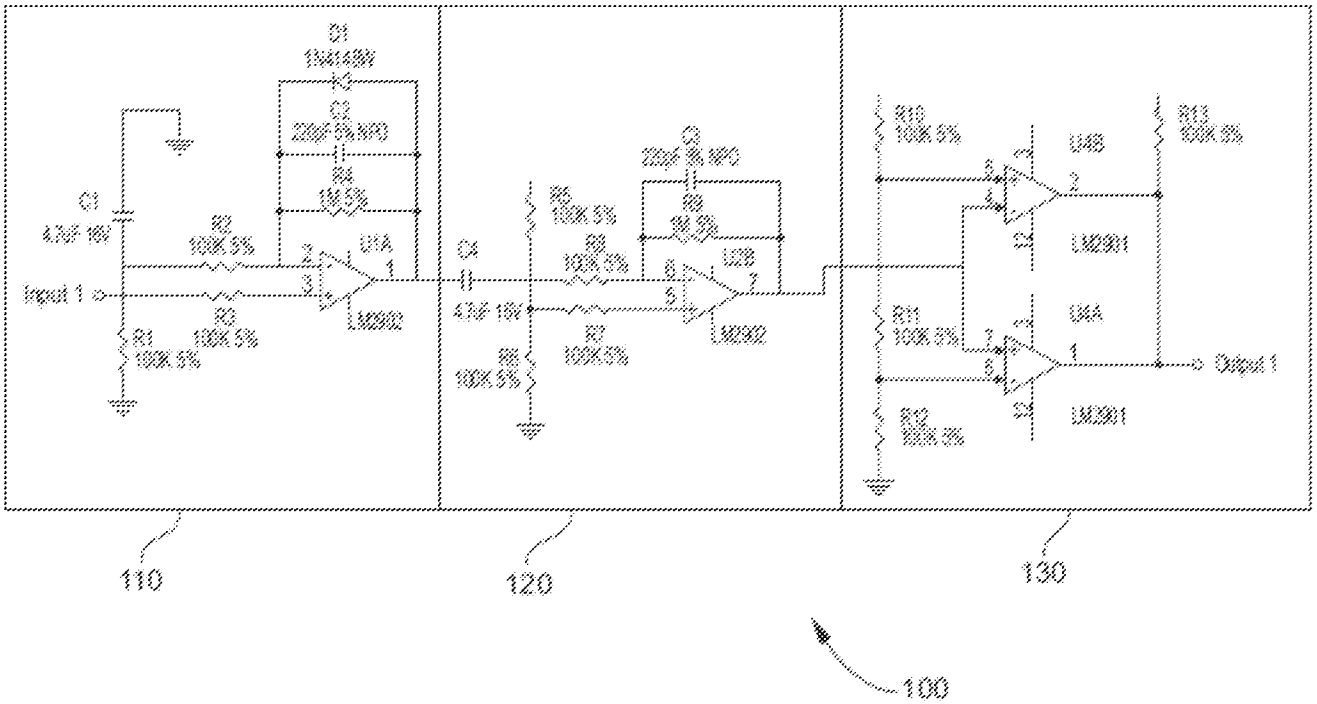
FIG. 3 is a schematic illustration of an embodiment of the controller circuit (any values shown on the drawing are merely exemplary and not limiting).

The sensor unit, an embodiment of its circuitry 100 is shown in FIG. 3, generally includes: at least two sensors in operational communication with a controller.

The sensors (not shown) may be located anywhere on the refrigerator, for example: on a lower portion of the refrigerator to observe the movement of the operator's feet, or in the dispenser to observe the movement of the operator's hands. The sensors may be any type of sensor. Suitable sensors include, for example, IR (infrared), RF (radio frequency), visible light, sound. The two sensors are spaced apart any suitable distance, as is well known. The sensors include a transmitter (source) and a receiver (sensor). Each sensor produces a signal that is operatively communicated to the controller.

The controller (not shown) may be any type of controller, for example, analog or digital (microprocessor based). In one embodiment, the circuitry (analog) is schematically illustrated in FIG. 3.

The controller, in general, uses an adaptive algorithm, embodied in the circuitry 100 illustrated in FIG. 3, to detect ambient changes identified by the sensors. This algorithm uses a calibration to identify changes in ambient conditions. During calibration, the controller reads the signal level present on the sensors and uses this as a new threshold. A valid input is now triggered whenever the sensor sees a level change, either higher or lower, than the calibrated threshold. In some cases, the signal output may not be sensitive enough to detect operator input. More specifically, to overcome the insensitivity, the illustrated circuitry may be employed. First, the output signals of the sensors are amplified 110. In section 110, the output levels will settle at some arbitrary bias level depending of ambient conditions and the bias level allows amplification of small changes in sensor input values that occur during input conditions. Since the amplifier of section 110 does not have a defined output level, the output level will be an arbitrary value somewhere between zero and the system voltage, depending on ambient conditions. Second, a level shifter section 120 may be used to bring the amplified output to a known value. The output of section 120 may be, for example, ½ the system voltage, so that swings above and below the known voltage (i.e., changes caused by the operator may be more readily detected by the controller). Additionally, in section 120, amplification may be added to further improve the sensitivity of the controller. Finally, a window comparator 130 section may be used. Window comparator 130 allows output changes from high level (at or near system voltage) to low level (at or near zero) whenever the level shifter 120 output goes above or below the two set points, which may be, for example, ⅔ system voltage and ⅓ system voltage. The level shifter section 120 and the window comparator 130 allows for the use of a simple digital input pin on microprocessor-based systems, versus an analog pin for systems without this stage. The level shifter section 120 and window comparator 130 also enables use of interrupts to alleviate processing load of the microcontroller. The window comparator 130 also allows for implementation of a motion sensor system without the need for a microprocessor. The output of window comparator 130 may also feed into a timed, latching circuit to turn lights on in the refrigerator 10.

Figure 4:
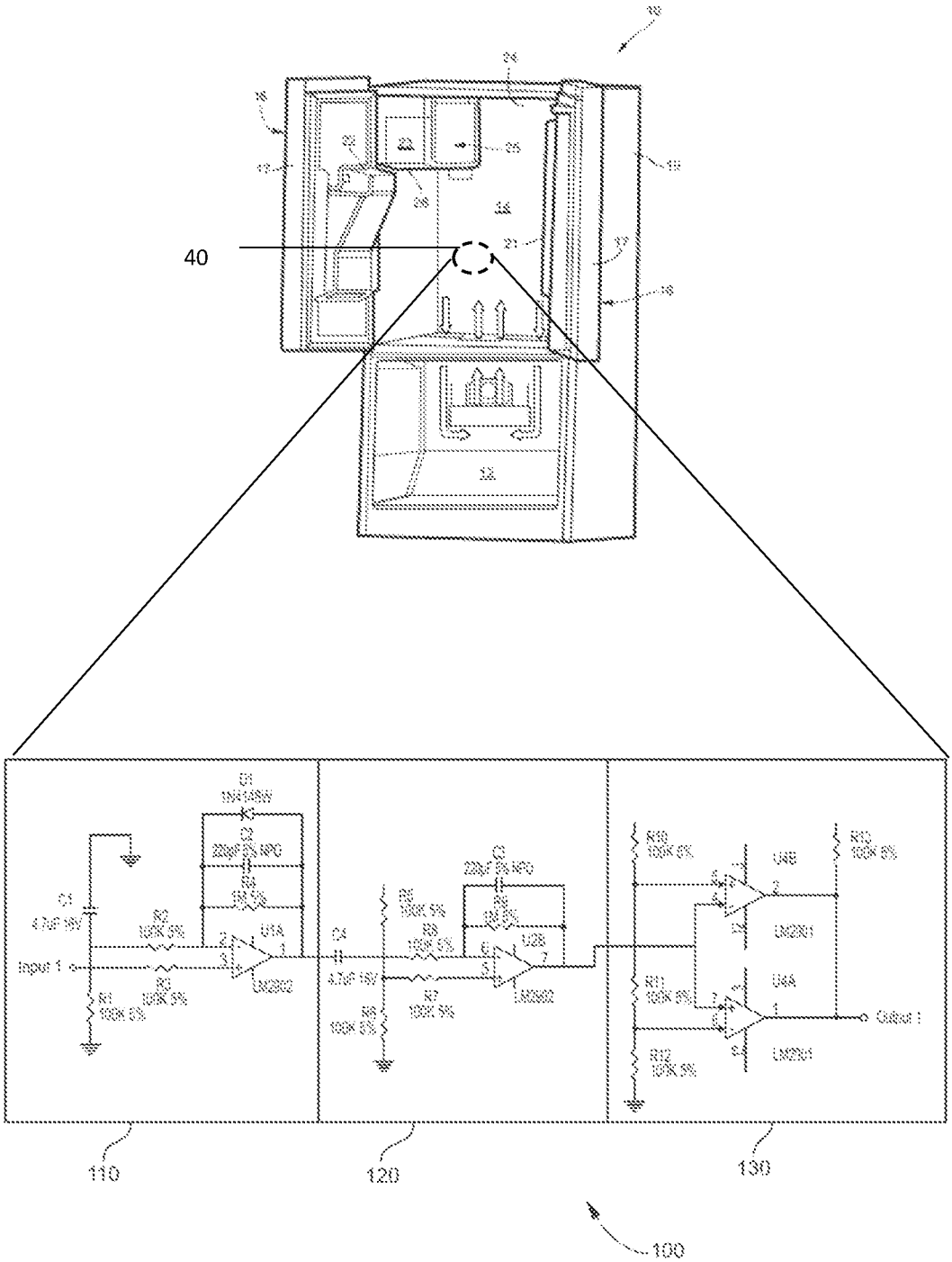
FIG. 4 is a schematic illustration of an embodiment of the controller circuit of a controller 40 shown in an exemplary position in a refrigerator 10.

FIG. 4 is a schematic illustration of an embodiment of the controller circuit of a controller 40 shown in an exemplary position in a refrigerator 10. Controller 40 is illustrated as within a back wall of the refrigerator but may be located anywhere within a refrigerator acceptable for positioning of a controller.

Operation of the controller is not limited by the foregoing theory, but may be embodied in other forms as is well known to those of ordinary skill.

The present invention may be embodied in other forms without departing from the spirit and the essential attributes thereof, and, accordingly, reference should be made to the appended claims, rather than to the foregoing specification, as indicating the scope of the invention.

I claim:

1. A refrigerator comprises:

a cabinet defining a refrigeration compartment with an opening and a door pivotally connected with the cabinet for movement between an open position allowing access to the refrigeration compartment and a closed position sealing the refrigeration compartment;

a see-through door with an interior light for illuminating the refrigeration compartment and/or a dispenser mounted in the door or in the cabinet for dispensing water and/or ice; and a sensor unit operatively associated with the interior light for controlling the interior light activation without direct contact via movement of the an operator in proximity to the refrigerator and/or the dispenser for controlling dispensing of water/or ice without direct contact via the movement of an operator in proximity to the refrigerator, the sensor unit including at least two spaced apart sensors in operational communication with a controller, each sensor producing an output signal, the controller senses a timing difference between the output signals from the at least two sensors caused by the movement of the operator to control dispensing, and the controller establishes a calibration setting based on the output signals of the sensor where ambient changes to the output signals are differentiated from the timing difference, wherein the calibration is obtained by amplifying the output signals to increase sensitivity.

2. The refrigerator of claim 1 wherein the at least two sensors are infra-red (IR) sensors.

3. The refrigerator of claim 1 wherein the calibration is obtained by amplifying the outputs signals and then using a level shifter to further amplify the output signals to a known value.

4. The refrigerator of claim 1 wherein the controller is analog or digital.

5. The refrigerator of claim 4 wherein the digital controller includes a window comparator.

6. A refrigerator comprises:

a cabinet defining a refrigeration compartment with an opening and a door pivotally connected with the cabinet for movement between an open position allowing access to the refrigeration compartment and a closed position sealing the refrigeration compartment;

a see-through door with an interior light for illuminating the refrigeration compartment and/or a dispenser mounted in the door or in the cabinet for dispensing water and/or ice; and a sensor unit operatively associated with the interior light for controlling the interior light activation without direct contact via movement of the an operator in proximity to the refrigerator and/or the dispenser for controlling dispensing of water/or ice without direct contact via the movement of an operator in proximity to the refrigerator, the sensor unit including at least two spaced apart sensors in operational communication with a controller, each sensor producing an output signal, the controller senses a timing difference between the output signals from the at least two sensors caused by the movement of the operator to control dispensing, and the controller establishes a calibration setting based on the output signals of the sensor where ambient changes to the output signals are differentiated from the timing difference, the calibration is obtained by amplifying the output signals to increase sensitivity.

7. The refrigerator of claim 6 wherein the at least two sensors are infra-red (IR) sensors.

8. The refrigerator of claim 6 wherein the controller is analog or digital.

9. The refrigerator of claim 8 wherein the digital controller includes a window comparator.

10. A refrigerator comprises:

a cabinet defining a refrigeration compartment with an opening and a door pivotally connected with the cabinet for movement between an open position allowing access to the refrigeration compartment and a closed position sealing the refrigeration compartment;

a see-through door with an interior light for illuminating the refrigeration compartment and/or a dispenser mounted in the door or in the cabinet for dispensing water and/or ice; and a sensor unit operatively associated with the interior light for controlling the interior light activation without direct contact via movement of the an operator in proximity to the refrigerator and/or the dispenser for controlling dispensing of water/or ice without direct contact via the movement of an operator in proximity to the refrigerator, the sensor unit including at least two spaced apart sensors in operational communication with a controller, each sensor producing an output signal, the controller senses a timing difference between the output signals from the at least two sensors caused by the movement of the operator to control dispensing, and the controller establishes a calibration setting based on the output signals of the sensor where ambient changes to the output signals are differentiated from the timing difference, the calibration is obtained by amplifying the outputs signals and then using a level shifter to further amplify the output signals to a known value.

11. The refrigerator of claim 10 wherein the at least two sensors are infra-red (IR) sensors.

12. The refrigerator of claim 10 wherein the calibration is obtained by amplifying the outputs signals and then using a level shifter to further amplify the output signals to a known value.

13. The refrigerator of claim 10 wherein the controller is analog or digital.

14. The refrigerator of claim 13 wherein the digital controller includes a window comparator.

* * * * *